US005238796A

United States Patent [19]

Maruyama et al.

[11] Patent Number: 5,238,796

[45] Date of Patent: Aug. 24, 1993

[54] SILVER HALIDE PHOTOGRAPHIC EMULSION AND PHOTOGRAPHIC LIGHT-SENSITIVE MATERIAL

[75] Inventors: Yoichi Maruyama; Shigeharu Urabe, both of Minami-ashigara, Japan

[73] Assignee: Fuji Photo Film Co., Ltd., Kanagawa, Japan

[21] Appl. No.: 788,536

[22] Filed: Nov. 6, 1991

[30] Foreign Application Priority Data

Nov. 14, 1990 [JP] Japan ..... 2-306072

[51] Int. Cl.[5] ..... G03C 1/035; G03C 1/46; G03C 7/32

[52] U.S. Cl. ..... 430/505; 430/543; 430/567; 430/569

[58] Field of Search ..... 430/567, 569, 505, 543

[56] References Cited

U.S. PATENT DOCUMENTS

| | | | |
|---|---|---|---|
| 4,414,306 | 11/1983 | Wey et al. | 430/567 |
| 4,414,310 | 11/1983 | Daubendiek et al. | 430/567 |
| 4,433,048 | 2/1984 | Solberg et al. | 430/567 |
| 4,434,226 | 2/1984 | Wilgus et al. | 430/567 |
| 4,435,501 | 3/1984 | Maskasky | 430/567 |
| 4,439,520 | 3/1984 | Kofron et al. | 430/567 |
| 4,459,353 | 7/1984 | Maskasky | 430/567 |
| 4,806,461 | 2/1989 | Ikeda et al. | 430/567 |
| 5,061,614 | 10/1991 | Takada et al. | 430/569 |
| 5,068,173 | 11/1991 | Takehara et al. | 430/567 |
| 5,079,138 | 1/1992 | Takada et al. | 430/567 |
| 5,096,806 | 3/1992 | Nakamura et al. | 430/567 |

FOREIGN PATENT DOCUMENTS

| | | | |
|---|---|---|---|
| 368275 | 5/1990 | European Pat. Off. | 430/567 |

OTHER PUBLICATIONS

Mitchell, J. Soc. Phot. Sci. Tech. Japan, vol. 48, No. 3, 1985, pp. 191–204.

Farnell, J. Phot. Sci., vol. 13, 1965, pp. 25–31.

Shiozawa, J. Soc. Phot. Sci. Japan, 34, 16 (1971), pp. 16–22.

Shiozawa, J. Soc. Phot. Sci. Japan, 35, 213 (1972), pp. 213–218.

Hamilton, Photo. Sci. and Eng., 11 (1967), pp. 57–68.

Berry, J. Appl. Phys., 27 (1956), pp. 636–639.

Berry, J. Appl. Phys., 35 (1964), pp. 2165–2169.

*Primary Examiner*—Janet C. Baxter

*Attorney, Agent, or Firm*—Birch, Stewart, Kolasch & Birch

[57] ABSTRACT

A silver halide photographic emulsion containing tabular silver halide grains which have an aspect ratio of 2 or more and in which dislocations are localized in a center portion of each grain. The tabular silver halide grains have a thickness of less than 0.5 μm and a diameter of 0.3 μm or more and account for at least 50% of a total projected area of the silver halide grains. This emulsion has a high sensitivity and good reciprocity characteristics. In a photographic light-sensitive material having at least two light-sensitive silver halide emulsion layers having different color sensitivities on a support, the above tabular silver halide photographic emulsion and at least one type of a coupler which is coupled with an oxidant of a color developing agent to develop a color are added to at least one of the emulsion layers, thereby obtaining a photographic light-sensitive material having a high sensitivity and good reciprocity characteristics.

20 Claims, 1 Drawing Sheet

SILVER HALIDE PHOTOGRAPHIC EMULSION AND PHOTOGRAPHIC LIGHT-SENSITIVE MATERIAL

BACKGROUND OF THE INVENTION

1. Field of the Invention

The present invention relates to a silver halide emulsion and a photographic light-sensitive material using the same and, more particularly, to a tabular silver halide grain emulsion having a high photographic sensitivity/granularity ratio and a photographic light-sensitive material using the same.

2. Description of the Related Art

Methods of manufacturing and using tabular silver halide grains (to be also referred to as simply "tabular grains" hereinafter) are disclosed in, e.g., U.S. Pat. Nos. 4,434,226, 4,439,520, 4,414,310, 4,433,048, 4,414,306, and 4,459,353. The tabular grain is known for its various advantages such as high sensitivity including an improvement in spectral sensitization efficiency obtained by a sensitizing dye, an improvement in a sensitivity/granularity relationship, an improvement in sharpness obtained by unique optical properties of the tabular grain, and an improvement in covering power.

In recent years, however, as the sensitivity of a silver halide color light-sensitive material has been increased and its small formatting has progressed, a strong demand has arisen for a color photographic light-sensitive material having high sensitivity and high image quality.

For this reason, a silver halide emulsion having higher sensitivity and better granularity is required. However, no conventional tabular silver halide emulsion can satisfy this requirement, and a demand has arisen for an emulsion having higher performance.

In the present invention, a technique of controlling dislocations to be formed in a center portion of a tabular silver halide grain is used in order to satisfy such requirement. A dislocation means a displacement in an atomic arrangement in a crystal lattice and is a kind of lattice defect. Since the origin of dislocations is not a thermodynamical one, no dislocations are included in crystals if the crystals are grown without being subjected to mechanical strain.

Dislocations in silver halide grains are described in, for example,:

1) C. R. Berry, J. Appl. Phys., 27, 636 (1956)
2) C. R. Berry, D. C. Skilman, J. Appl. Phys., 35, 2165 (1964)
3) J. F. Hamilton, Phot. Sci. Eng., 11, 57 (1967)
4) T. Shiozawa, J. Soc. Phot. Sci. Jap. 34, 16 (1971)
5) T. Shiozawa, J. Soc. Phot. Sci. Jap., 35, 213 (1972)

These references describe that dislocations in crystals can be observed by an X-ray diffraction method or a low-temperature transmission electron microscopic method and that various dislocations can be formed in crystals by giving strain to the crystals.

An influence of dislocations on photographic properties is described in G. C. Farnell, R. B. Flint, and J. B. Chanter, J. Phot. Sci., 13, 25 (1965). This reference describes that a formation position of a latent image nucleus in a large tabular silver bromide grain having a high aspect ratio and defects in the grain are in a close relationship.

J. W. Mitchell, J. Soc. Phot. Sci. Jap., 48, 191 (1985) describes a study of the tabular grain. According to this reference, dispersion of a latent image easily occurs in the tabular grain because the ratio of a surface area with respect to a volume is large in the tabular grain. The reference considers that in order to prevent this dispersion, electrons must be concentrated at the corner of the tabular grain, and preferably, at a singular point at the center of its major face to determine a latent image site.

JP-A-58-108526 ("JP-A" means unexamined published Japanese patent application) is an example of putting the above studies into practical use. JP-A-58-108526 discloses a tabular silver halide emulsion in which silver salt is coordinated in selected portions of parallel opposing (1,1,1) major faces of a tabular silver halide grain having an aspect ratio of 8 or more.

For example, an iodide concentration is controlled or a site director is adsorbed to major faces to coordinate AgCl in the corner or the central portion of a tabular grain.

This coordinated compound (epitaxy) of AgCl (or another silver salt such as AgSCN) is effective to limit the latent image site. On the other hand, since the coordinated compound has a high solubility and forms a mixed crystal with a host grain, it easily changes in subsequent steps (washing, chemical sensitization, coating, and incubation of a coated product). Therefore, it is difficult to maintain the performance of the compound.

Each of JP-A-63-220238 and JP-A-1-201649 discloses a tabular silver halide grain in which dislocations are formed on purpose. According to these patent specifications, tabular grains having dislocation lines are superior to those having no dislocation lines in photographic properties such as sensitivity and reciprocity. In addition, good sharpness and graininess can be imparted to a light-sensitive material by using these tabular grains. However, since a large number of dislocation lines are irregularly formed about the edges of these tabular grains, they are still unsatisfactory in terms of concentration of latent image formation sites.

SUMMARY OF THE INVENTION

The present invention has been made in consideration of the above situation, and has as its first object to provide a silver halide emulsion having high sensitivity.

It is a second object of the present invention to provide a silver halide emulsion having good reciprocity characteristics.

The above objects of the present invention can be achieved by the following means.

(1) A silver halide photographic emulsion containing tabular silver halide grains which have an aspect ratio of 2 or more and in which dislocations are concentrated in a center portion of each grain.

(2) A silver halide photographic emulsion described in item (1) above, wherein tabular silver halide grains having a grain thickness of less than 0.5 μm, a grain size of 0.3 μm or more, and an aspect ratio of 2 or more account for at least 50% of a total projected area of all the silver halide grains.

(3) A photographic light-sensitive material having at least two light-sensitive silver halide emulsion layers having different color sensitivities on a support, wherein at lest one of the emulsion layers contains a silver halide photographic emulsion described in item (2) above and at least one type of a coupler which is coupled with an oxidant of a color developing agent to develop a color.

DETAILED DESCRIPTION OF THE PREFERRED EMBODIMENTS

Figure 1:
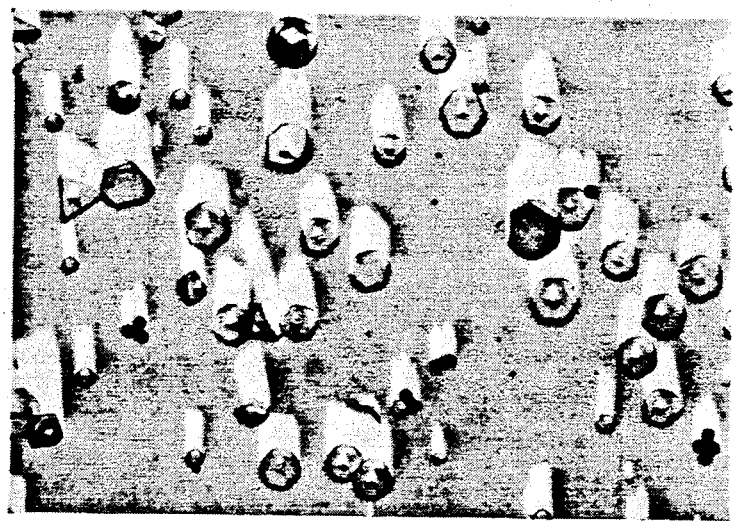
FIG. 1 is an electron micrograph showing a crystal structure in which silver chloride is epitaxially grown at the center of a tabular grain in an emulsion (1-B) of Example 1.

An emulsion of the present invention contains one or more tabular silver halide grains having an aspect ratio of 2 or more, (i.e. "not less than 2") and preferably, less than 8. In the present invention, a tabular silver halide grain is a general term indicating a grain having a twining plane or two or more parallel twining planes. In this case, if atoms at lattice points at two sides of a (1,1,1) face are in a mirror image relationship, this (1,1,1) face is the twining plane. When the tabular grain is viewed from the above, it looks triangular or hexagonal, or circular which is generally triangular or hexagonal with each corner rounded. Triangular, hexagonal, and circular grains have triangular, hexagonal, and circular parallel outer surfaces, respectively.

In the present invention, an average aspect ratio of tabular grains is an average value of values (aspect ratios) obtained by dividing grain sizes of tabular grains having grain sizes of 0.3 μm or more by their thicknesses. In order to measure the grain thickness, a metal is deposited in an oblique direction of a grain, together with a latex as a reference, and the length of its shadow is measured by an electron microscope The grain thickness can be calculated on the basis of the length of the shadow of the latex.

In the present invention, the grain size means a diameter of a circle having the same area as a projected area of parallel outer surfaces of a grain.

The projected area of a grain can be obtained by measuring an area of the grain image on an electron micrograph and correcting it with a magnification.

The diameter of a tabular grain is preferably 0.3 to 5.0 μm. The thickness of a tabular grain is preferably 0.05 to 0.5 μm.

In the present invention, a ratio of tabular grains in an emulsion is preferably 50%, and most preferably, 80% or more of a total projected area of all silver halide grains in the emulsion. More preferably, an average aspect ratio of the tabular grains occupying this predetermined area is 3 to less than 8. In addition, more preferable effects may be obtained by using monodispersed tabular grains. Although a structure of the monodispersed tabular grains and a method of manufacturing the same are described in, e.g., JP-A-63-151618, the shape of the grains will briefly described below. That is, hexagonal tabular silver halide grains in which a ratio of the length of the longest edge to the length of the shortest edge is 2 or less and which have two parallel faces as outer surfaces account for 70% or more of a total projected surface area of silver halide grains, and a variation coefficient (a value obtained by dividing a variation, or standard deviation, in grain sizes each represented by an equivalent-circle diameter of a projected area of a grain by an average grain size) in grain size distribution of the hexagonal tabular silver halide grains is 20% or less, i.e., the grains have monodispersibility.

The tabular emulsion of the present invention have dislocations.

Dislocations in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, a silver halide grain is carefully extracted from an emulsion so as not to apply a pressure capable of forming dislocations in the grain and is placed on a mesh for electron microscopic observation, and observation is performed by cooling the sample so as to prevent damage (e.g., print out) caused by electron rays. In this case, as the thickness of a grain is increased, it becomes difficult to transmit electron rays. Therefore, a grain can be observed more clearly by using an electron microscope of high voltage type (200 kV or more with respect to a grain having a thickness of 0.25 fm). By using a photograph of a grain obtained by the above method, positions of dislocations can be determined for each grain when the grain is viewed in a direction perpendicular to the major face.

In the present invention, dislocations in a silver halide grain are localized in a center portion of a tabular grain. The center portion of a tabular grain means a center columnar region occupying from the center to a position corresponding to 10% of the diameter of a circle having the same area as a projected area of parallel outer surfaces of the grain.

"Dislocations are localized the center portion" means that the dislocation density in a center portion is higher than that in the peripheral portion. The dislocation density is defined by the number of dislocation lines per predetermined projected area. The dislocation density in a center portion is preferably twice or more, and more preferably, 10 times to 1,000 times or more that in a portion except for the center portion.

A method of preparing tabular grains of the present invention will be described below. Tabular grains of the present invention can be obtained by four steps of:

a) manufacturing tabular grains (also called "host grains"), as substrates;
b) epitaxially growing a silver halide on a central portion of each tabular grain as a substrate;
c) performing halogen conversion for the epitaxially grown silver halide; and
d) growing dislocations by silver halide shell formation.

Although a halogen composition of the tabular grain as a substrate described in step a) may be any of silver bromide, silver iodobromide, silver chlorobromide, and silver chloroiodobromide, the tabular grain preferably has a structure in which silver iodide is contained in the peripheral portion of the grain where no dislocations are formed. More preferably, the peripheral portion contains 0.1 mol % or more of silver iodide. On the other hand, the silver iodide content in a center portion where dislocations are formed is arbitrary as long as it is lower than that in the peripheral portion where no dislocations are formed.

These grains are used as host grains to epitaxially grow silver halide. The silver halide to be grown may be arbitrarily selected from silver chloride, silver chlorobromide, and silver bromide. In this growth, an addition amount of silver nitrate and halogen is preferably 0.1 to 20 mol %, and more preferably, 0.5 to 10 mol % of that of substrate grains.

The epitaxially grown silver halide is subjected to halogen conversion. The halogen conversion means a treatment in which the halogen which forms silver halide crystals is substituted by a different halogen. The conversion is caused by adding a halogen capable of forming a silver halide having a smaller solubility product than that of the silver halide present in the form of a crystal and is started from a portion where the silver halide has a larger solubility. Therefore, a halogen for performing the halogen conversion may be arbitrarily selected as long as it can form silver halide grains having a smaller solubility than that of the epitaxially grown silver halide.

An addition amount of the halogen is preferably 5 to 100 mol %, and more preferably, 10 to 50 mol % with respect to silver amount contained in the epitaxially grown silver halide. If the amount of the halogen added for conversion is smaller than the above amount, desired dislocations disappear upon recrystallization caused in the subsequent dislocation growth step. If the amount is large, conversion is caused with respect to another portion of each substrate grain to form dislocations in an undesired portion.

Growth of dislocations will be described below.

In the step of halogen conversion, irregularity is caused in a lattice of the silver halide. In this state, if silver nitrate and potassium bromide, or silver nitrate and a mixed solution of potassium bromide and potassium iodide are simultaneously added, grain are further grown but dislocations are formed on the basis of the irregularity in the lattice. When a potassium iodide solution is used as a solution for halogen conversion, silver iodide ($\beta$-AgI) having a hexagonal lattice different from a face-centered cubic lattice of the substrate is formed by the conversion, and dislocations are formed on the basis of this $\beta$-AgI.

The amount of silver nitrate and the halogen added in this step is arbitrarily set as long as it is 5 mol % or more of that of the substrate grains. When the mixed solution of potassium bromide and potassium iodide is added, the ratio of potassium iodide is preferably 0.01 to 0.4 mol, and more preferably, 0.03 to 0.1 mol per mol of potassium bromide.

A photographic light-sensitive material of the present invention has at least two light-sensitive silver halide emulsion layers having different color sensitivities on a support, and at least one of the emulsion layers contains at least one type of a coupler which is coupled with an oxidant of a color developing agent to form a color. The photographic light-sensitive material of the present invention can be applied to a multilayered silver halide color photographic light-sensitive material to be subjected to color development, e.g., color paper, color reversal paper, a color positive film, a color negative film, a color reversal film, and a direct positive color light-sensitive material. In particular, the present invention can be preferably applied to color paper and color reversal paper.

In the multilayered silver halide color photographic light-sensitive material, color-sensitive layers are generally formed such that red-, green-, and blue-sensitive layers are arranged from a support in the order named or a reverse order. In accordance with an application, however, another light-sensitive layer such as an infrared-sensitive layer may be used, or light-sensitive layers having the same color sensitivity may sandwich a light-sensitive layer having different color sensitivity.

Non-light-sensitive layers such as various interlayers may be formed between the silver halide light-sensitive layers and as the uppermost layer or the lowermost layer.

As the non-light-sensitive layer, a protective layer, an interlayer, a filter layer, and an antihalation layer can be used in accordance with an application. These layers may contain a non-light-sensitive emulsion, e.g., a fine grain emulsion.

A so-called back layer may be formed on the side of a support opposite to emulsion layers in order to adjust curling or prevent charge or adhesion. The back layer may be either a single layer or a plurality of layers.

Practical layer arrangements are, e.g., red-sensitive layer (R)/green-sensitive layer (G)/blue-sensitive layer (B)/support and B/G/R/support. A layer arrangement in which a plurality of layers having the same color sensitivity but different sensitivities are also useful. More specifically, an order of high-sensitivity blue-sensitive layer (BH)/low-sensitivity blue-sensitive layer (BL)/high-sensitivity green-sensitive layer (GH)/low-sensitivity green-sensitive layer (GL)/high-sensitivity red-sensitive layer (RH)/low-sensitivity red-sensitive layer (RL)/support or an arrangement in which high- and low-sensitivity layers of an arbitrarily light-sensitive layer are switched in this order.

As described in JP-B-55-34932 ("JP-B" means examined published Japanese patent application), layers may be arranged in an order of blue-sensitive layer/GH/RH/GL/RL from the farthest side from a support. In addition, as described in JP-A-56-25738 and JP-A-62-63936, layers may be arranged in an order of blue-sensitive layer/GL/RL/GH/RH from the farthest side from a support.

Furthermore, layers may be arranged in an order of high-sensitivity emulsion layer/low-sensitivity emulsion layer/medium-sensitivity emulsion layer or low-sensitivity emulsion layer/medium-sensitivity emulsion layer/high-sensitivity emulsion layer.

In order to improve color reproducibility, as described in U.S. Pat. Nos. 4,663,271, 4,705,744, and 4,707,436, JP-A-62-160448, and JP-A-63-89580, a donor layer (CL) with an interlayer effect having a different spectral sensitivity distribution from those of main light-sensitive layers such as BL, GL, and RL are preferably arranged adjacent to or close to the main light-sensitive layers.

As described above, various layer arrangements and orders can be selected in accordance with the application of a light-sensitive material.

A silver halide emulsion to be used together with the emulsion of the present invention may contain any silver halide such as silver iodobromide, silver bromide, silver chlorobromide, and silver chloride.

Although a halogen composition may be different between grains contained in an emulsion, uniform properties can be easily obtained between grains when an emulsion having grains with an equal halogen composition is used. As a halogen composition distribution in the interior of a silver halide emulsion grain, a grain having a so-called uniform structure in which a composition is equal in any portion of a silver halide grain, a grain having a so-called stacked structure having different halogen compositions in a core of a silver halide grain and a shell (one or a plurality of layers) surrounding the core, or a grain having a structure in which a non-layer portion having a different halogen composition is formed in the interior or the surface of the grain (if the portion is formed on the grain surface, the portion having a different composition is junctioned to the edge, the corner, or the face of the grain) may be arbitrarily selected. In order to obtain high sensitivity, the latter two types of grains can be used more advantageously than the grain having the uniform structure. These two types are preferable in terms of a resistance to pressure. When the silver halide grain has the above structure, a boundary portion between portions having different halogen compositions may be a clear boundary or an unclear boundary in which a mixed crystal is formed due to a composition difference. In addition, the structure may be continuously changed on purpose.

A halogen composition of an emulsion varies in accordance with the type of light-sensitive material. For example, a silver chlorobromide emulsion is mainly used in a printing material such as color paper, and a silver iodobromide emulsion is mainly used in a photographic material such as a color negative film.

A so-called high silver chloride emulsion having a high silver chloride content is preferably used in a light-sensitive material suitable for a rapid treatment. The silver chloride content of the high silver chloride emulsion is preferably 90 mol % or more, and more preferably, 95 mol % or more.

Such a high silver chloride emulsion preferably has a structure in which a silver bromide localized region is formed in the form of layer or non-layer in the interior and/or the surface of the silver halide grain. The localized region preferably has a silver bromide content of at least 10 mol %, and more preferably, more than 20 mol %. The localized regions can be formed in the interior, at the edge or the corner of the surface, or on the surface of the grain. For example, the localized region is preferably epitaxially grown at the corner portion of a grain.

An average grain size of silver halide grains which can be used in the light-sensitive material of the present invention (the average grain size is an average value of a grain size based on a projected area of a grain. The grain size is a grain diameter if grains are spherical or almost spherical, an edge length if grains are cubic, and an equivalent-sphere diameter if grains are tabular grains) is preferably 0.1 to 2 μm, and most preferably, 0.15 to 1.5 μm. Although a grain size distribution may be narrow or wide, a so-called monodispersed silver halide emulsion in which a value (variation coefficient) obtained by dividing a standard deviation of a granularity distribution curve of a silver halide emulsion by an average grain size is 20% or less, and most preferably, 15% or less is preferably used in the light-sensitive material of the present invention. In order to allow the light-sensitive material to satisfy desired gradation, in emulsion layers having essentially the same color sensitivity, two or more types of monodispersed silver halide emulsions (preferably having the above variation coefficient as monodispersibility) having different grain sizes can be mixed in the same layer or coated on different layers. In addition, two or more types of polydispersed silver halide emulsions or a combination of monodispersed and polydispersed emulsions can be mixed or used in different layers.

A silver halide grain in a photographic emulsion which can be used together in the photographic light-sensitive material of the present invention may have a regular crystal such as a cubic crystal, octahedral crystal, rhombic dodecahedral crystal, tetradecahedral crystal, or a mixture thereof, an irregular crystal such as a spherical or tabular crystal, or a combination thereof.

The silver halide emulsion which can be used in the present invention can be prepared by using methods described in, for example, Research Disclosure (RD), No. 17643 (December, 1978) PP. 22 and 23, "I. Emulsion Preparation and Types", and RD No. 18716 (November, 1979), P. 648; P. Glafkides, "Chemie et Phisique Photographique", Paul Montll, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, e.g.,. U.S. Pat. Nos. 3,574,628 and 3,655,394, and British Patent 1,413,748 are also preferable.

A tabular having an aspect ratio of about 5 or more can be used in the present invention. The tabular grain can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

A crystal structure may be uniform, may have different halogen compositions in its inner and outer portions, or may be a layered structure. Alternatively, a silver halide having a different composition may be bonded by an epitaxial junction, or a compound other than a silver halide such as silver rhodanate or zinc oxide may be bonded.

In addition, a mixture of grains having various crystal forms can be used.

The photographic emulsion of the present invention and the silver halide emulsion used together in the present invention are normally subjected to physical ripening, chemical ripening, and spectral sensitization, and then used. Additives used in these steps are described in research Disclosures Nos. 17643 and 18716, and they are summarized as follows.

Known photographic additives which can be used in the present invention are also described in these two Research Disclosures, and they are summarized in the following Table.

| Additives | RD No. 17643 | RD No. 18716 |
|---|---|---|
| 1. Chemical sensitizers | Page 23 | page 648, right column |
| 2. Sensitivity increasing agents | | page 648, right column |
| 3. Spectial sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, right column |
| 7. Stain preventing agents | page 25, right column | page 650, left to right column |
| 8. Dye image stabilizer | page 25 | |
| 9. Hardening agents | page 26 | page 651, left column |
| 10. Binder | page 26 | page 651, left column |
| 11. Plasticizers, | pate 27 | page 650, |

-continued

| Additives | RD No. 17643 | RD No. 18716 |
|---|---|---|
| lubricants | | right column |
| 12. Coating aids, surface active agents | pages 26–27 | page 650, right column |
| 13. antistatic agents | page 27 | page 650, right column |

In order to prevent degradation in photographic properties caused by formaldehyde gas, a compound which can react with and fix formaldehyde described in U.S. Pat. Nos. 4,411,987 or 4,435,503 is preferably added to the light-sensitive material.

Various color couplers can be used in the light-sensitive material of the present invention, and specific examples of these couplers are described in patents described in above-mentioned Research Disclosure (RD), No. 17643, VII-C to VII-G.

Preferred examples of a yellow coupler are described in, e.g., U.S. Pat. Nos. 3,933,501, 4,022,620, 4,326,024, 4,401,752, and 4,428,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 04795/88 can be used.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658 can be used.

Preferable examples of a colored coupler for correcting additional, undesirable absorption of a colored dye are those described in Research Disclosure No. 17643, VII-G, U.S. Pat. No. 4,163,670, JP-A-57-39413, U.S. Pat. Nos. 4,004,929 and 4,138,258, and British Patent 1,146,368. A coupler for correcting unnecessary absorption of a colored dye by a fluorescence dye released upon coupling described in U.S. Pat. No. 4,774,181 or a coupler having a dye precursor group which can react with a developing agent to form a dye as a split-off group described in U.S. Pat. No. 4,777,120 may be preferably used.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, 4,367,282, 4,409,320, and 4,576,910 and British Patent 2,102,173.

Couplers releasing a photographically useful residue upon coupling are preferably used in the present invention. DIR couplers, i.e., couplers releasing a development inhibitor are described in the patents cited in the above-described RD No. 17643, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator are described in British Patents 2,097,140 and 2,131,188, JP-A-59-157638, and JP-A-59-170840.

Examples of a coupler which can be used in the light-sensitive material of the present invention are competing couplers described in, e.g., U.S. Pat. No. 4,130,427: poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a ligand releasing coupler described in, e.g., U.S. Pat. No. 4,553,477; a coupler releasing a leuco dye described in JP-A-63-75747; and a coupler releasing a fluorescence dye described in U.S. Pat. No. 4,774,181.

The couplers for use in this invention can be added to the light-sensitive material by various known dispersion methods.

Examples of a high-boiling organic solvent used in an oil-in-water dispersion method are described in, e.g., U.S. Pat. No. 2,322,027. Steps, effects, and examples of a latex for impregnation of a latex dispersion method as a polymer dispersion method are described in, e.g., U.S. Pat. No. 4,199,363 and West German Patents (OLS) 2,541,274 and 2,541,230, and a dispersion method using an organic solvent-soluble polymer is described in PCT WO 00723/88.

Examples of an organic solvent for use in the oilin-water dispersion method are an alkyl phthalate (e.g., dibutyl phthalate and dioctyl phthalate), phosphate (e.g., diphenyl phosphate, triphenyl phosphate, tricresyl phosphate, and dioctylbutyl phosphate), a citrate (e.g., tributyl acetylcitrate), a benzoate (e.g., octyl benzoate), an alkylamide (e.g., diethyllaurylamide), an aliphatic ester (e.g., dibutoxyethylsuccinate and diethylazelate), and a trimesate (e.g., tributyl trimesate). Also, an organic solvent having a boiling point of 30° C. to 150° C. may be used. Examples of such an organic solvent are a lower alkyl acetate, e.g., ethyl acetate and butyl acetate, ethyl propionate, secondary butyl alcohol, methylisobutylketone, $\beta$-ethoxyethyl acetate, and methylcellosolve acetate. Unnecessary components may be removed from these dispersions by washing with water or pressure reduction.

A standard use amount of a color coupler is 0.001 to 1 mol per mol of a light-sensitive silver halide. Preferable amounts of yellow, magenta, and cyan couplers are 0.01 to 0.5 mol, 0.003 to 0.3 mol, and 0.002 to 0.3 mol, respectively, per mol of a silver halide.

Various types of an antiseptic agent or a mildewproofing agent are preferably added to the color light-sensitive material of the present invention. Examples of the antiseptic agent and the mildewproofing agent are 1,2-benzisothiazolin-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The photographic light-sensitive material used in the present invention is coated on a flexible support such as a plastic film (consisting of cellulose nitrate, cellulose acetate, or polyethylene terephthalate) or paper or a rigid support such as glass, which are normally used. Examples of the support and a coating method are described in detail in Research Disclosure, Vol. 176, Item 17643 XV (page 27) - XVII (page 28) (December, 1978).

The light-sensitive material manufactured by the present invention may contain a hydroquinone derivative, an aminophenol derivative, a gallate derivative, or an ascorbic acid derivative as a color fog inhibitor.

Various types of dye stabilizers can be used in the light-sensitive material of the present invention. Typical examples of an organic decoloration inhibitor for a cyan, magenta, and/or yellow image are a hydroquinone, a 6-hydroxychroman, 5-hydroxycoumaran, a spirochroman, a p-alkoxyphenol, a hinderedphenol such as a bisphenol, a gallate derivative, a methylenedioxybenzene, an aminophenol, a hinderedamine, an ether obtained by sililating or alkylating a phenolic hydroxyl group of these compounds or an ester devivertive thereof. In addition, a metal complex such as a (bis-salicylaldoximato)nickel complex and a (bis-N,N-dialkyldithiocarbamato)nickel complex can be used.

Practical examples of the organic decoloration inhibitor are described in the following specifications.

That is, examples of a hydroquinone are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028; examples of a 6-hydroxychroman, 5-hydroxycoumaran, and a spirochroman are described in U.S. Pat. Nos. 3,432,300, 3,573,050, 3,574,627, 3,698,909, and 3,764,337, and JP-A-52-152225; an example of a spiroindan is described in U.S. Pat. No. 4,360,589; examples of a p-alkoxyphenol is described in U.S. Pat. No. 2,735,765, British Patent 2,066,975, JP-A-59-10539, and JP-B-57-19765; examples of a hinderedphenol are described in U.S. Pat. No. 3,700,455, JP-A-52-72224, U.S. Pat. No. 4,228,235, and JP-B-52-6623; examples of a gallic acid derivative, a methyleneoxybenzene, and an aminophenol are described in U.S. Pat. Nos. 3,457,079 and 4,332,886 and JP-B-56-21144, respectively; examples of a hinderedamine are described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; examples of a metal complex are described in U.S. Pat. Nos. 4,050,938 and 4,241,155 and British Patent 2,027,731(A). 5 to 100 wt % of these compounds are emulsified together with corresponding color couplers and added to light-sensitive layers, thereby achieving the desired objects.

In order to prevent degradation in a cyan dye image caused by heat and especially light, an ultraviolet absorbent can be effectively added to a cyan colorforming layer and two adjacent layers.

Examples of the ultraviolet absorbent are a benzotriazole compound substituted by an aryl group (described in, e.g., U.S. Pat. No. 3,533,794), a 4-thiazolidone compound (described in, e.g., U.S. Pat. Nos. 3,314,794 and 3,352,681), a benzophenone compound (described in, e.g., JP-A-46-2784), a cinnamate compound (described in, e.g., U.S. Pat. No. 3,705,805 and 3,707,395), a butadiene compound (described in U.S. Pat. No. 4,045,229), and a benzooccidol compound (described in, e.g., U.S. Pat. No. 3,700,455). In addition, an ultraviolet absorptive coupler (e.g., α-naphthol-based cyan dye-forming coupler) and an ultraviolet absorptive polymer can be used. These ultraviolet absorbents may be mordanted in a specific layer.

Of the above compounds, a benzotriazole compound substituted by an aryl group is most preferable.

Gelatin can be advantageously used as a binder or a protective colloid which can be used in emulsion layers of the light-sensitive material of the present invention. Also another hydrophilic colloid can be used singly or in combination with gelatin.

In the present invention, gelatin may be either lime- or acid-processed. A method of manufacturing gelatin is described in detail in Arthur Weis, "The Macromolecular Chemistry Of Gelatin", (Academic Press, 1964).

The color light-sensitive material of the present invention has at least one layer containing a light-sensitive silver halide emulsion and a coupler on a support. The light-sensitive silver halide emulsion is normally spectrally sensitized to obtain blue, green, and red sensitivities. However, infrared light sensitivity or medium spectral sensitivity may be imparted in accordance with an application. The type of color sensitivity depends on the type of exposure light source such as sun light, tungsten light, an LED, and a laser. The number and order of emulsion layers and non-light-sensitive layers are not particularly limited. For example, the light-sensitive material has at least one light-sensitive layer constituted by a plurality of silver halide emulsion layers having essentially the same color sensitivity but different sensitivities on a support.

A color photographic light-sensitive material generally uses a combination of the above color-sensitive layers. A relationship between the color-sensitivity of an emulsion and the hue of a colored dye of a coupler is generally such that yellow, magenta, and cyan couplers are used for blue-, green-, and red-sensitive layers, respectively. However, this combination can be changed in accordance with an application.

A color developer used in developing of the light-sensitive material of the present invention is an aqueous alkaline solution containing, as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ehtyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. These compounds can be used in a combination of two or more thereof in accordance with applications.

In general, the color developer contains a pH buffering agent such as a carbonate, a borate or a phosphate of an alkali metal, and a development restrainer or antifoggant such as bromides, iodides, benzimidazoles, benzothiazols or a mercapto compounds. If necessary, the color developer may also contain a preservative such as hydroxylamine, diethylhydroxylamine, hydrazine sulfites, phenylsemicarbazides, triethanolamines, catechol sulfonates or triethylenediamine(1,4-diazabicyclo[2,2,-2]octane)s; an organic solvent such as ethyleneglycol or diethyleneglycol; a development accelerator such a benzylalcohol, polyethyleneglycol, a quaternary ammonium salt or amines; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

In order to perform reversal development, generally, black-and-white development is performed and then color development is performed. As a black-and-white developer, known black-and-white developing agents, e.g., a dihydroxybenzene such as hydroquinone, 3-pyrazolidones such as 1-phenyl-3-pyrazolidone, and an aminophenol such as N-methyl-p-aminophenol can be used singly or in a combination of two or more thereof.

The pH of the color developer and black-and-white developer is generally 9 to 12. Although a replenishment amount of the developer depends on a color photographic light-sensitive material to be processed, it is generally 3 liters or less per $m^2$ of the light-sensitive material. The amount of a replenisher can be decreased to be 500 ml or less by decreasing a bromide ion concentration in the replenisher. In case of decreasing the amount of a replenisher, a contact area of a processing solution with air in a processing tank is preferably decreased to prevent evaporation and oxidation of the solution upon contact with air. The amount of a replenisher can be decreased by using a means capable of suppressing an accumulation amount of bromide ions in the developer.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with application. Examples of the bleaching agent are a compound of a multivalent metal such as iron (III), cobalt (III), chromium (VI) and copper (II); peroxides; quinones; and nitro compounds. Typical examples of the bleaching agent are a ferricyanide; a bichromate; an organic complex salt of iron (III) or cobalt (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and a nitrobenzene. Of these compounds, an aminopolycarboxylato ferrate (III) such as ethylenediaminetetraacetato ferrate (III), and a persulfate are preferred because they can increase a processing speed and prevent an environmental pollution. The aminopolycarboxylato ferrate (III) is effective in both the bleaching and bleach-fixing solutions. The pH of the bleaching or bleach-fixing solution containing the aminopolycarboxylato ferrate (III) is normally 5.5 to 8. In order to increase the processing speed, however, processing can be performed at a lower pH.

A bleaching accelerator can be used in the bleaching solution, the bleach-fixing solution and their pre-bath, if necessary. Effective examples of the beaching accelerator are: compounds having a mercapto group or a disulfide bond described in, e.g., U.S. Pat. No. 3,893,858, West German Patent 1,290,812, JP-A-53-95630, and Research disclosure, No. 17,129 (July, 1978); a thiazolidine derivative described in JP-A-50-140129; thiourea derivatives described in U.S. Pat. No. 3,706,561; iodides described in JP-A-58-16235; polyoxyethylene compounds described in West German Patent 2,748,430; a polyamine compound described in JP-B-45-8836; and a bromide ion. Of these compounds, compounds having a mercapto group or a disulfide group are preferably used since they are excellent in promoting effect. In particular, compounds described in U.S. Pat. No. 3,893,858, West German Patent 1,290,812, and JP-A-53-95630 can be preferably used. In addition, a compound described in U.S. Pat. No. 4,552,834 can be preferably used. These bleaching accelerators may be added to the light-sensitive material. These bleaching accelerators are effective especially i bleach-fixing of a photographic color light-sensitive material.

Examples of the fixing agent are a thiosulfate, a thiocyanate, a thioether-based compound, thioureas and a large amount of an iodide. Of these compounds, a thiosulfate, especially, ammonium thiosulfate can be used in a widest range of applications. As a preservative of the bleach-fixing solution, a sulfite, a bisulfite or a carbonly bisulfite adduct is preferred.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing mode representing a counter or forward current, and other conditions. The relationship between the amount of water and the number of water tanks in a multi-stage counter-curent mode can be obtained by a method described in "Journal of the Society of Motion picture and Television Engineers", Vol. 64, PP. 248-253 (May, 1955).

According to the above-described multi-stage counter-current mode, the amount of water used for washing can be greatly decreased. Since washing water stays in the tanks for a long period of time, however, bacteria multiply and floating substances produced by bacteria may be undesirably attached to the light-sensitive material. In order to solve this problem in the process of the photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides described in Hiroshi Horiguchi, "Chemistry of antibacterial and Antifungal Agents", Sankyo Shuppan (1986), Eiseigijutsu-Kai ed., "Sterilization, Antibacterial, and Antifungal Techniques for Microorganisms", Kogyo Gijutsu Kai (1982), and Nippon Bokin Bokabi Gakkai ed., "Dictionary of Antibacterial and Antifungal Agante" can be used.

The pH of the water for washing the photographic light-sentivive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing formalin and a surfactant to be used as a final bath of the photographic color light-sensitive material. Various chelating agents or antifungal agents can be added in the stabilizing bath.

An overflow solution produced upon washing and/or replenishment of the stabilizing solution can be reused in another step such as a desilvering step.

The photographic light-sensitive material of the present invention may contain a color developing agent in order to simplify processing and increase a processing speed. For this purpose, various types of precursors of a color developing agent can be preferably used. Examples of the precursor are an indoanilinebased compound disclosed in U.S. Pat. No. 3,342,597, Schiff base compounds described in U.S. Pat. No. 3,342,599 and Research Disclosure Nos. 14,850 and 15,159, an aldol compound described in Research Disclosure No. 13,924, a metal salt complex described in U.S. Pat. No. 3,719,492 and an urethane-based compound described in JP-A-53-135628.

The photographic light-sensitie material of the present invention may contain various 1-phenyl-3-pyrazolidones in order to accelerate color development if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a high temperature to shorten a processing time, or image quality or stability of a processing solution may be improved at a lower temperature. In order to save silver for the light-sensitive material, processing using cobalt intensification or hydrogen peroxide intensification described in West German Patent No. 2, 226,770 or U.S. Pat. No. 3,674,499 may be performed.

When the light-sensitive material of the present invention is to be used in the form of roll, it is preferably housed in a cartridge. A most general type of the cartridge is a currently used 135-format patrone. In addition, cartridges proposed in patents to be enumerated below can be used. JU-A-58-67329 ("JU-A-" means Unexamined Published Japanese Utility Model Application), JP-A-58-181035, JP-A-58-182634, JU-A-58-195236, U.S. Pat. No. 4,221,479, JP-A-01-231045, Japanese Patent Application No. 63-183344, JA-A-2-170156, Japanese Patent Application Nos. 1-25362, 1-30246, 1-20222. 1-21863, 1-37181, 1-33108, 1-85198, 1-172595, and 1-172594, and 1-172593, and U.S. Pat. Nos. 4,846,418, 4,848,693, and 4,832,275).

The present invention will be described in more detail below by way of the following examples.

EXAMPLE 1

(1) Preparation of emulsion

(Base emulsion 1-A)

An emulsion containing host grains was manufactured as follows.

150 cc of a 2.00 M silver nitrate solution and a 2.00 M potassium bromide solution were added to 1 liter of a 0.8 wt % gelatin solution containing 0.08 M of potassium bromide under stirring by a doubled jet method. The gelatin solution was held at a temperature of 30° C. during the addition and heated up to 75° C. after the addition. 30 g of gelatin were added after the addition. After the resultant material was physically ripened at 75° C. for 20 minutes, 1 g of 3,6-dioctane-1,8-diol was added.

After the addition, ripening was further performed for 30 minutes. Grains (to be referred to as seed crystals hereinafter) formed in this manner were washed by a conventional flocculation method and adjusted to have a pH of 5.0 and a pAg of 7.5 at 40° C.

1/10 of the above crystals was dissolved in 1 liter of a solution containing 3 wt % of gelatin, and the resultant solution was held at a temperature of 75° C. and a pBr of 2.55. Thereafter, 150 g of silver nitrate and a potassium bromide solution containing 8 M % of potassium iodide were added at an accelerated flow rate (a flow rate at the end of addition was 19 times that at the beginning) over 60 minutes. During the addition, the pBr was held at 2.55.

Thereafter, the resultant emulsion was cooled to 35° C. and washed by the normal flocculation method. After the emulsion was adjusted to have a pH of 6.5 and a pAg of 8.6 at 40° C., it was stored in a cold and dark place. Hexagonal tabular grains account for 80% of the obtained tabular grains, and the variation coefficient of the grains was 18%. The average equivalent circle diameter of projected areas of the grains was 2.2 μm, and their average thickness was 0.3 μm.

(Emulsion 1-B) Preparation of an emulsion having dislocation lines in a center portion a) 300 cc of distilled water was added to 500 g of the emulsion 1-A, and the resultant mixture was heated up to 40° C. A silver nitrate solution (concentration = 1.02 mol/l) in an amount corresponding to 5 mol % of a silver amount of the emulsion and a sodium chloride solution (concentration = 1.58 mol/l,) were added by the doubled jet method over 10 minutes.

b) A potassium iodide solution (concentration = 0.04 mol/l) in an amount corresponding to 2 mol % of the silver amount of the emulsion 1-A were added over 8 minutes.

c) A silver nitrate solution (concentration = 1.02 mol/l) in an amount corresponding to 50 mol % of the silver amount of the emulsion 1-A and a potassium bromide solution (concentration = 1.02 mol/l) were added over 49 minutes while pBr = 1.73 was held.

d) Desalting was performed by the flocculation method.

(Emulsion 1-C) Preparation of an emulsion having dislocations in a fringe

The steps b), c), and d) of the procedure of preparing the emulsion 1-B were performed. In the step c), a silver nitrate solution in a amount corresponding to 55 mol % of the silver amount of the emulsion containing host grains and a potassium bromide solution were added. (Emulsion 1-D) Preparation of an emulsion having no dislocation lines Only the steps c) and d) of the steps a) to d) described in the preparation of the emulsion 1-B were performed. In the step c), a silver nitrate solution in an amount corresponding to 55 mol % of the silver amount of the base emulsion and a potassium bromide solution were added.

The average equivalent circle diameter of projected areas of the emulsions 1-B, 1-C, and 1-D was 2.4 μm, and the average thickness of their grains was 0.35 μm.

(2) Observation of grains

In each of the emulsions 1-B, 1-C, and 1-D, epitaxial growth was observed by a replica method during formation of grains.

Figure 2:
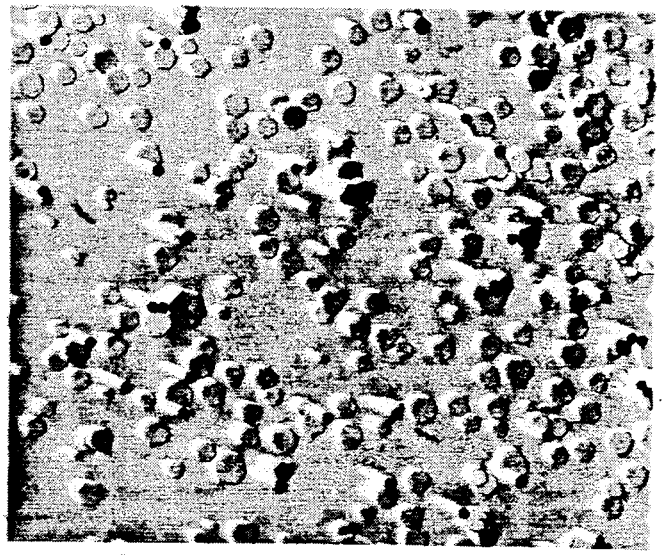
FIG. 2 is an electron micrograph showing a crystal structure in which silver iodide is epitaxially grown in a fringe portion of a tabular grain in an emulsion (1-C) of Example 1.

FIGS. 1 and 2 are photographs each showing a replica obtained when the step a) was finished for the emulsion 1-B and the step b) was finished for the emulsion 1-C, respectively. Each of FIGS. 1 and 2 is an electron micrograph at a magnification of x3,000.

While epitaxial growth wa present only in a center portion of each grain in the emulsion 1-B, it was present in a fringe portion in the emulsion 1-C. Since an epitaxial growth portion coincides with a dislocation formation position, it can be easily assumed that the emulsion 1-B has dislocations only in a center portion of each grain whereas the emulsion 1-C has dislocations only in a fringe portion of each grain. No dislocation lines were formed in the emulsion 1-D not subjected to the step of epitaxial growth.

(3) Chemical sensitization

1. Sulfur sensitization $1.6\times10^{-7}$ mol of sodium thiosulfate were added to 60 g ($3.6\times10^{-2}$ molAg) of each of the emulsions 1-B, 1-C, and 1-D, and the resultant emulsion was held at 60° C. for 60 minutes, thereby performing sulfur sensitization.

2. Gold-plus-sulfur sensitization

Optimal amounts of sodium thiosulfate, potassium thiocyanate, and chloroauric acid were added to 60 g ($3.6\times10^{-2}$ molAg) of each of the emulsions 1-B, 1-C, and 1-D, and the resultant emulsion was held at 60° C. for 60 minutes, thereby performing gold-plus-sulfur sensitization. The optimal amount means an amount by which the highest sensitivity is obtained upon 1/100 sec exposure.

(4) Preparation and evaluation of coating samples

Each of the emulsions subjected to the above chemical sensitization and a protective layer were coated in coating amounts as shown in Table 1 on a triacetylcellulose film support having an undercoating layer, thereby forming a coating sample of each emulsion.

TABLE 1

| Emulsion Coating Conditions | |
|---|---|
| (1) Emulsion Layer | |
| Emulsion . . . each type of above described emulsions | (silver $3.6\times10^{-2}$ mol/m$^2$) |
| Coupler | ($1.5\times10^{-3}$ mol/m$^2$) |

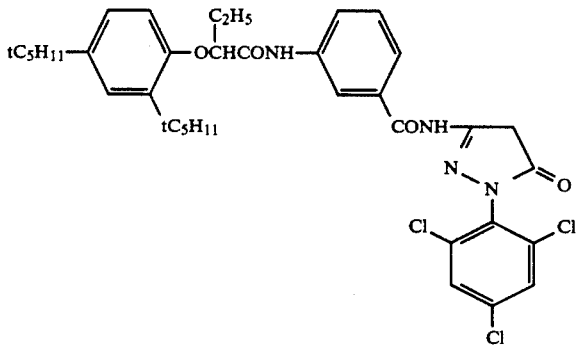

| | |
|---|---|
| Tricresylphosphate | (1.10 g/m$^2$) |
| Gelatin | (2.30 g/m$^2$) |
| (2) Protective Layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours and exposed through a continuous wedge for 1/100 second and 10 seconds so that each exposure amount was equal, and the following color development was performed.

The density of each developed sample was measured using a green filter.

| Step | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Dry | 50 sec. | 65° C. |

The processing solution compositions will be described below.

| (Color Developing Solution) | (g) |
|---|---|
| Diethylenetriaminepentaacetic acid | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2- | 4.5 |

-continued

| | |
|---|---|
| methylaniline sulfate | |
| Water to make | 1.0 l |
| pH | 10.05 |
| (Bleach-Fixing Solution) | (g) |
| Ammonium ethylenediaminetetraacetato ferrate (III) (dihydrate) | 90.0 |
| Disodium ethylenediaminetetraacetate | 5.0 |
| Sodium sulfite | 12.0 |
| Aqueous ammonium thiosulfate solution (70%) | 260.0 ml |
| Acetic acid (98%) | 5.0 ml |
| Bleaching accelerator | 0.01 mol |

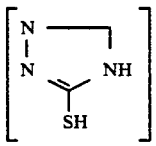

| | |
|---|---|
| Water to make | 1.0 l |
| pH | 6.0 |
| (Washing Solution) | |
| Tap water was supplied to a mixed-bed column filled with an H type strongly acidic cation exchange resin (Amberlite IR-120B: available from Rohm & and Haas Co.) and an OH type anion exchange resin (Amberlite IR-400) to set the concentrations of calcium ion and magnesium ion to be 3 mg/l or less. Subsequently, 20 mg/l of sodium dichloroisocyanurate and 1.5 g/l of sodium sulfate were added. The pH of the solution fell within the range of 6.5 to 7.5 | |
| (Stabilizing Solution) | (g) |
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0 to 8.0 |

The sensitivity is represented by a relative value of a reciprocal of an exposure amount indicated by lux.sec for giving a density of fog+0.2.

Table 2 shows the results of samples subjected to sulfur sensitization, and Table 3 shows those of samples subjected to gold-plus-sulfur sensitization.

TABLE 2

Relative sensitivity of samples subjected to sulfur sensitization

| Emulsion | Exposure time (sec) 1/100 | 10 | |
|---|---|---|---|
| 1-B | 132 | 132 | Present Invention |
| 1-C | 130 | 105 | Comparative Example |
| 1-D | 100 | 91 | Comparative Example |

Note:
The sensitivity is relatively represented assuming that sensitivity obtained when the sample 1-D was exposed for 1/100 sec was 100.

TABLE 3

Relative sensitivity of samples subjected to gold-plus-sulfur sensitization

| Emulsion | Exposure time (sec) 1/100 | 10 | |
|---|---|---|---|
| 1-B | 108 | 108 | Present Invention |
| 1-C | 105 | 100 | Comparative Example |
| 1-D | 100 | 95 | Comparative Example |

Note:
The sensitivity is relatively represented assuming that a sensitivity obtained when the sample 1-D was exposed for 1/100 sec was 100.

As is apparent from Tables 2 and 3, the emulsion 1-B of the present invention is higher in both 1/100-sensitivity and 10-sec sensitivity and more excellent in reciprocity characteristics than the emulsions 1-C and 1-D, that is, thereby indicating the significant effect of the present invention.

EXAMPLE 2

A plurality of layers having compositions as shown below were coated on an undercoated triacetylcellulose film support to form a multilayered color light-sensitive material, and the emulsion 1-B, 1-C, or 1-D (subjected to optimal gold-plus-sulfur sensitization described in Example 1 was added to the first bluesensitive emulsion layer of the multilayered color light-sensitive material, thereby forming samples 201 to 203.

(Compositions of light-sensitive layers)

Numerals corresponding to each component indicates a coating amount represented in units of g/m$^2$. The coating amount of a silver halide is represented by the coating amount of silver. The coating amount of a sensitizing dye is represented in units of mols per mol of a silver halide in the same layer. Emulsions A to I used are described in Table 4 (to be presented later), and formulas of compounds represented by symbols are listed in Table 5 (to be presented later).

| (Samples 201 to 203) | |
|---|---|
| Layer 1: Antihalation layer | |
| Black colloidal silver silver | 0.18 |
| Gelatin | 1.40 |
| Layer 2: Interlayer | |
| 2,5-di-t-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Layer 3: 1st red-sensitive emulsion layer | |
| Emulsion A silver | 0.25 |
| Emulsion B silver | 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.34 |
| EX-10 | 0.020 |
| U-1 | 0.070 |
| U-2 | 0.050 |
| U-3 | 0.070 |
| HBS-1 | 0.060 |
| Gelatin | 0.87 |
| Layer 4: 2nd red-sensitive emulsion layer | |
| Emulsion G silver | 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.40 |

-continued (Samples 201 to 203)

| | |
|---|---|
| EX-3 | 0.050 |
| EX-10 | 0.015 |
| U-1 | 0.070 |
| U-2 | 0.050 |
| U-3 | 0.070 |
| Gelatin | 1.30 |
| Layer 5: 3rd red-sensitive emulsion layer | |
| Emulsion D silver | 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.6 |
| Layer 6: Interlayer | |
| EX-5 | 0.040 |
| HBS-1 | 0.020 |
| Gelatin | 0.80 |
| Layer 7: 1st green-sensitive emulsion layer | |
| Emulsion A silver | 0.15 |
| Emulsion B silver | 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Layer 8: 2nd green-sensitive emulsion layer | |
| Emulsion C silver | 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Layer 9: 3rd green-sensitive emulsion layer | |
| Emulsion E silver | 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| EX-11 | 0.10 |
| EX-13 | 0.015 |

-continued (Samples 201 to 203)

| | |
|---|---|
| HBS-1 | 0.25 |
| HBS-2 | 0.10 |
| Gelatin | 1.54 |
| Layer 10: Yellow filter layer | |
| Yellow colloidal silver silver | 0.050 |
| EX-5 | 0.080 |
| HBS-1 | 0.030 |
| Gelatin | 0.95 |
| Layer 11: 1st blue-sensitive emulsion layer | |
| Emulsion 1-B, 1-C, or 1-D silver | 0.015 |
| Emulsion F silver | 0.070 |
| Sensitizing dye VIII | $3.5 \times 10^{-4}$ |
| EX-8 | 0.042 |
| EX-9 | 0.72 |
| HBS-1 | 0.28 |
| Gelatin | 1.10 |
| Layer 12: 2nd blue-sensitive emulsion layer | |
| Emulsion G silver | 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Layer 13: 3rd blue-sensitive emulsion layer | |
| Emulsion H silver | 0.77 |
| Sensitizing dye VII | $2.2 \times 10^{-4}$ |
| EX-9 | 0.20 |
| HBS-1 | 0.070 |
| Gelatin | 0.69 |
| Layer 14: 1st protective layer | |
| Emulsion I silver | 0.20 |
| U-4 | 0.11 |
| U-5 | 0.17 |
| HBS-1 | $5.0 \times 10^{-2}$ |
| Gelatin | 1.00 |
| Layer 15: 2nd protective layer | |
| H-1 | 0.40 |
| B-1 (diameter = 1.7 fm) | $5.0 \times 10^{-2}$ |
| B-2 (diameter = 1.7 fm) | 0.10 |
| B-3 | 0.10 |
| S-1 | 0.20 |
| Gelatin | 1.20 |

In addition, in order to improve storage stability, processability, resistance to pressure, antiseptic and mildewproofing properties, antistatic properties, and coating properties, W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rhodium salt were added to all of the above layers.

TABLE 4

| Emulsion | Average AgI content (%) | Average grain size (μm) | Variation coefficient (%) according to grain size | Diameter/ thickness ratio | Silver amount ratio (AgI content %) |
|---|---|---|---|---|---|
| A | 4.0 | 0.45 | 27 | 1 | Core/shell = ⅓ (13/1), Double structure grain |
| B | 8.9 | 0.70 | 14 | 1 | Core/shell = 3/7 (25/2), Double structure grain |
| C | 10 | 0.75 | 30 | 2 | Core/shell = ⅓ (24/3), Double structure grain |
| D | 16 | 1.05 | 35 | 2 | Core/shell = 4/6 (40/0), Double structure grain |
| E | 10 | 1.05 | 35 | 3 | Core/shell = ⅓ (24/3), Double structure grain |
| F | 4.0 | 0.25 | 28 | 1 | Core/shell = ⅓ (13/1), Double structure grain |
| G | 14.0 | 0.75 | 25 | 2 | Core/shell = ⅓ (42/0), Double structure grain |
| H | 14.5 | 1.30 | 25 | 3 | Core/shell = 37/63 (34/3), Double structure grain |
| I | 1 | 0.07 | 15 | 1 | Uniform grain |

TABLE 5
EX-1
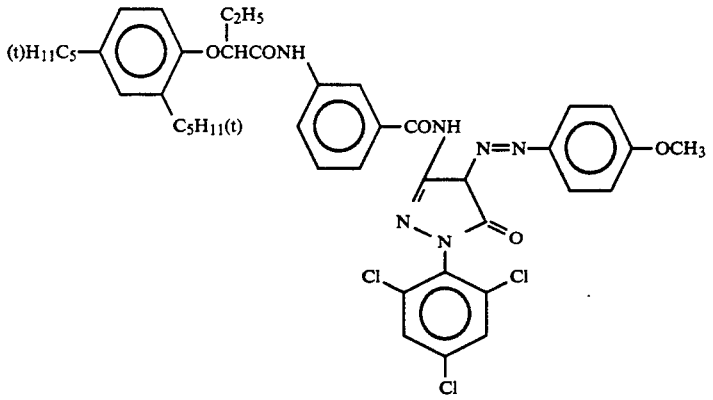
EX-2
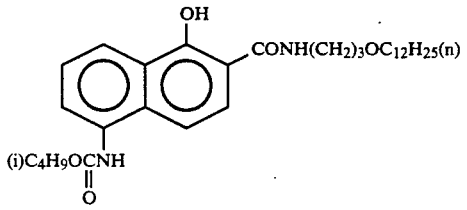
EX-3
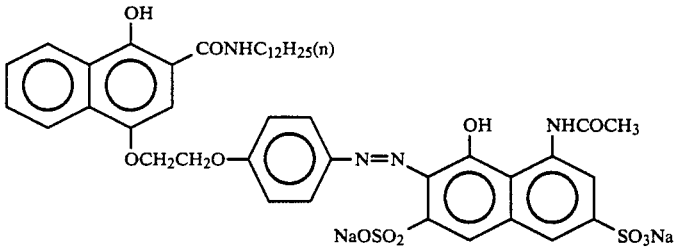
EX-4
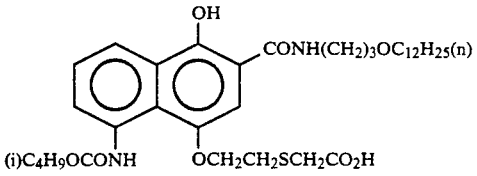
EX-5
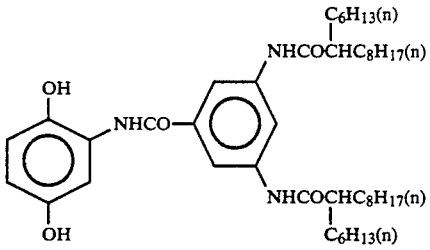
EX-6
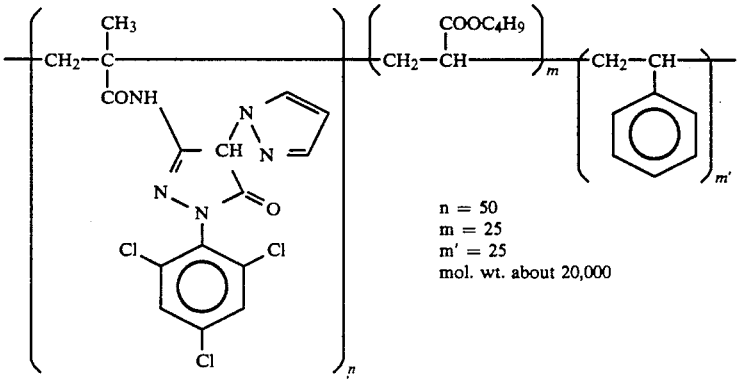
EX-7

TABLE 5-continued
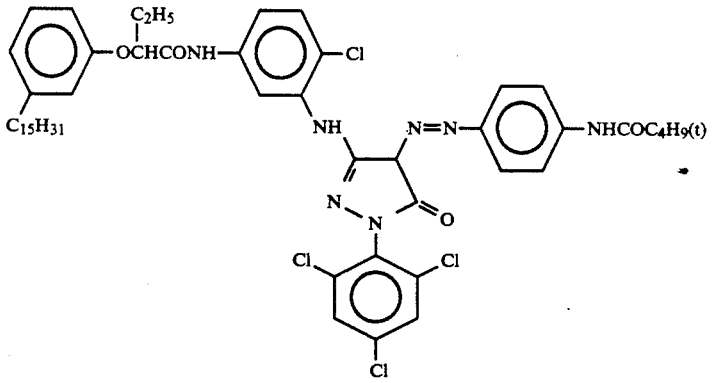
EX-8
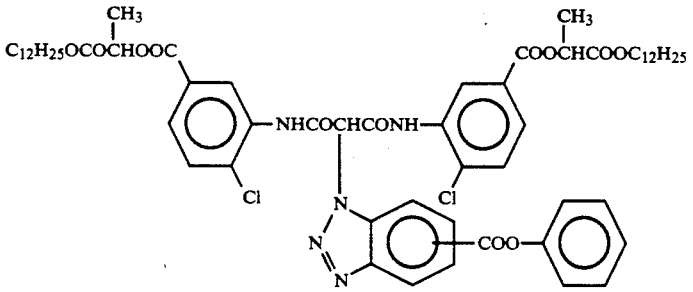
EX-9
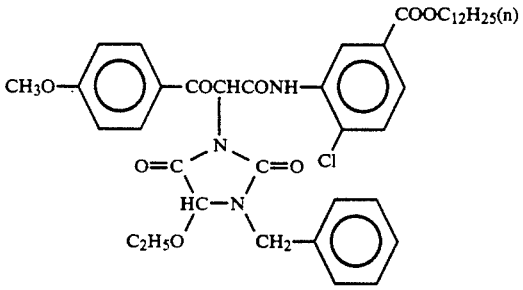
EX-10
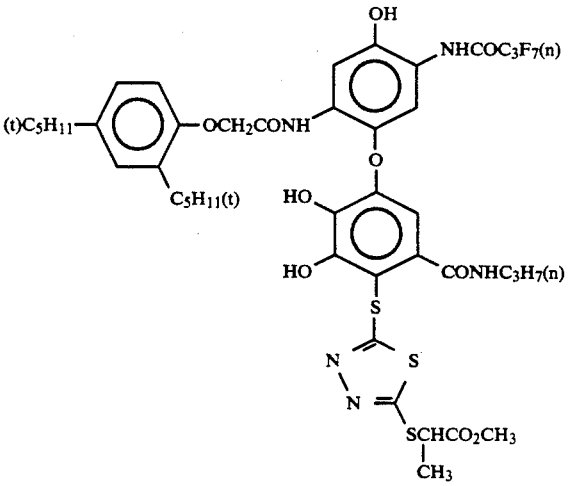
EX-11

TABLE 5-continued
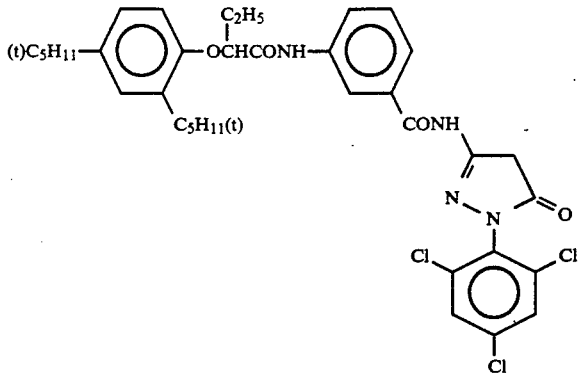
EX-12
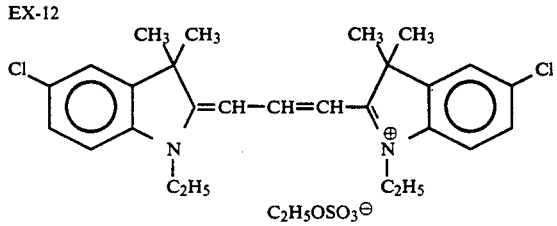
EX-13
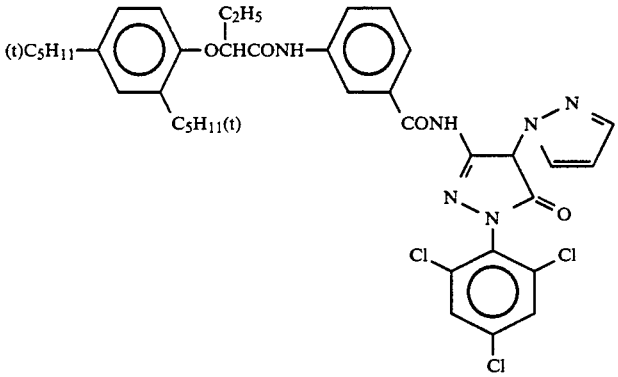
U-1
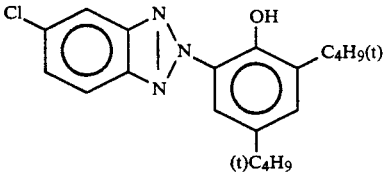
U-2
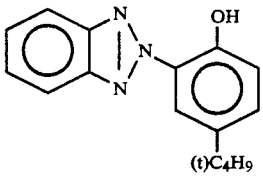
U-3
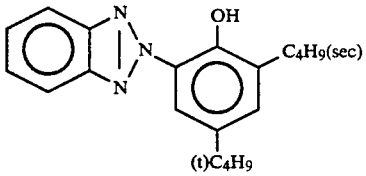
U-4
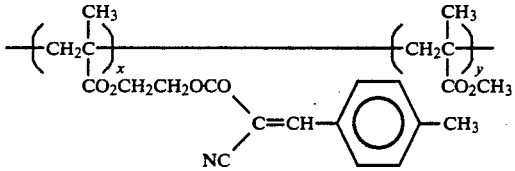
x:y = 70:30 (wt %)
U-5
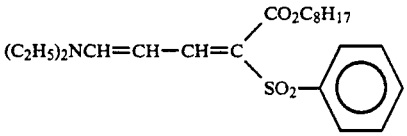
HBS-1
Tricresylphosphate
HBS-2
HBS-3

TABLE 5-continued
Di-n-butylphthalate
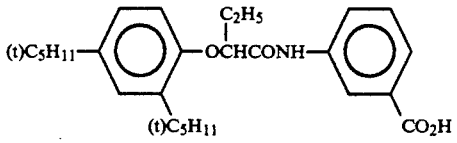
Sensitizing dye I
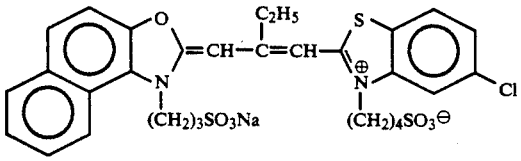
Sensitizing dye II
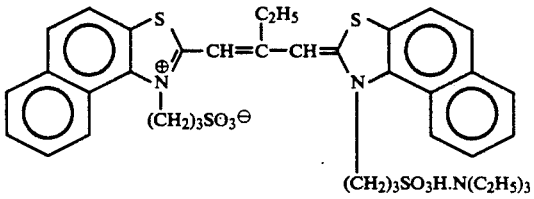
Sensitizing dye III
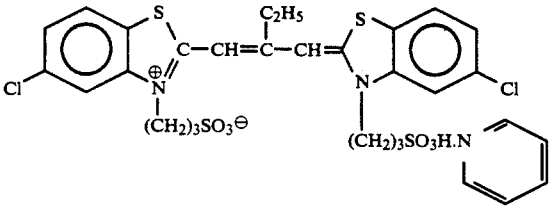
Sensitizing dye IV
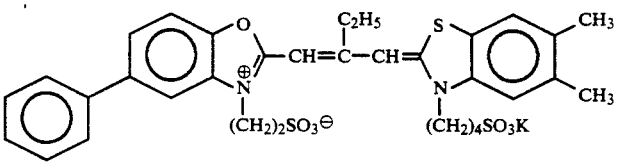
Sensitizing dye V
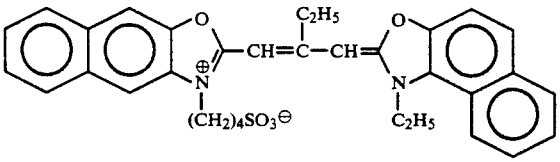
Sensitizing dye VI
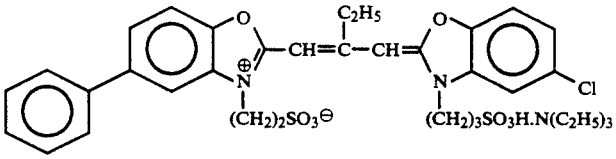
Sensitizing dye VII
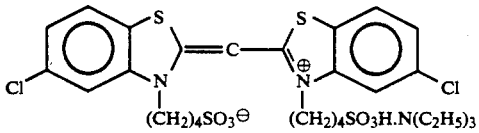
S-1
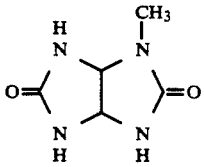
H-1
$CH_2{=}CH{-}SO_2{-}CH_2{-}CONH{-}CH_2$
$CH_2{=}CH{-}SO_2{-}CH_2{-}CONH{-}CH_2$
B-1
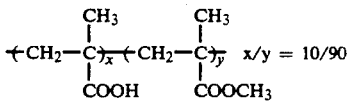
x/y = 10/90
B-2
B-3

TABLE 5-continued
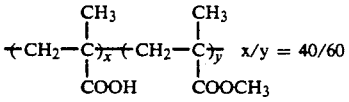
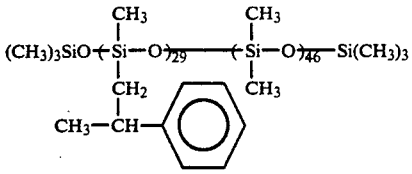
B-4
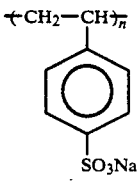
B-5
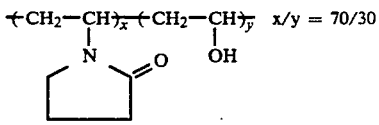
W-1
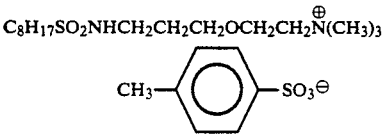
W-2
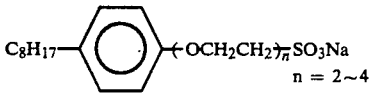
W-3
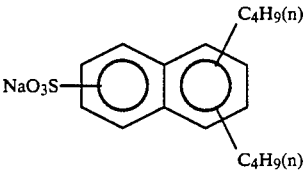
F-1
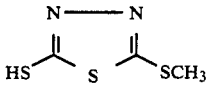
F-2
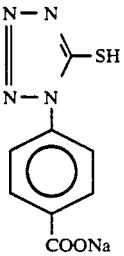
F-3
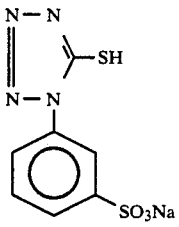
F-4
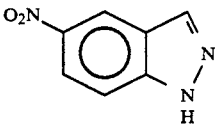
F-5
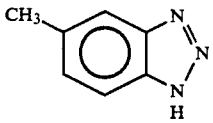
F-6
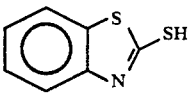
F-7
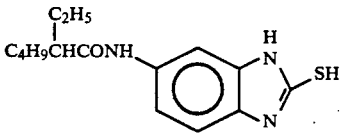
F-8
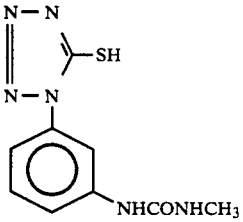
F-9
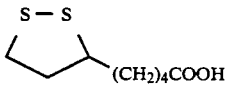

TABLE 5-continued

F-10

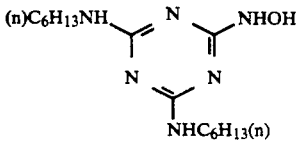

F-11

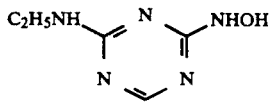

F-12

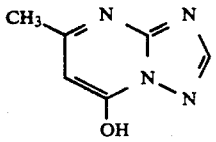

F-13

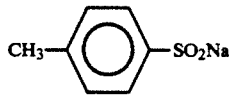

The samples 201 to 203 obtained in this manner were exposed and treated by a method described in Table 6 using an automatic developing machine (until an accumulated quantity of replenisher of a bleaching solution was three times the volume of a corresponding mother solution tank).

TABLE 6

| Processing Method | | | | |
|---|---|---|---|---|
| Process | Time | Temperature | Quantity of Replenisher | Tank volume |
| Color development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1,200 ml | 20 l |
| Fixing | 4 min. 20 sec. | 38° C. | 25 ml | 30 l |
| Washing (1) | 1 min. 05 sec. | 24° C. | Counter flow piping from (2) to (1) | 10 l |
| Washing (2) | 1 min. 00 sec. | 24° C. | 1,200 ml | 10 l |
| Stabilization | 1 min. 05 sec. | 38° C. | 25 ml | 10 l |
| Drying | 4 min. 20 sec. | 55° C. | | |

(A quantity of replenisher per meter of a 35-mm wide sample)

The compositions of the processing solutions will be presented below.

| | Mother solution (g) | Replenisher (g) |
|---|---|---|
| Color developing solution: | | |
| Diethylenetriamine-pentaacetate | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |
| Bleaching solution: | | |
| Sodium ethylenediamine-tetraacetato ferrate (III) trihydrate | 100.0 | 120.0 |
| Disodium ethylene-diaminetetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| Fixing solution: | | |

-continued

| | Mother solution (g) | Replenisher (g) |
|---|---|---|
| Disodium ethylene-diaminetetraacetate | 0.5 | 0.7 |
| Sodium sulfite | 7.0 | 8.0 |
| Sodium bisulfite | 5.0 | 5.5 |
| Aqueous ammonium thiosulfate solution (70%) | 170.0 ml | 200.0 ml |
| Water to make | 1.0 l | 1.0 l |
| pH | 6.7 | 6.6 |
| Stabilizing solution: | | |
| Formalin (37%) | 2.0 ml | 3.0 ml |
| Polyoxyethylene-p-monononylphenylether (average polymerization degree = 10) | 0.3 | 0.45 |
| Disodium ethylene-diaminetetraacetate | 0.05 | 0.08 |
| Water to make | 1.0 l | 1.0 l |
| pH | 5.8-8.0 | 5.8-8.0 |

The sensitivity of the first blue-sensitive layer was evaluated on the basis of an exposure amount for giving a density higher by 1.5 than the minimum yellow density. The sensitivity of the emulsion 1-B of the present invention in which dislocations were concentrated in a center portion was higher in both 10 sec exposure and 1/100 sec exposure than those of the emulsion 1-C in which dislocations were uniformly present on the edge of each grain and the emulsion 1-D having no dislocations, thereby indicating the significant effect of the present invention.

As has been described above, according to the present invention, a silver halide emulsion having a high sensitivity and good reciprocity characteristics can be provided.

What is claimed is:

1. A silver halide photographic emulsion containing tabular silver halide grains which have an aspect ratio of not less than 2 and in which dislocations are concentrated in a center portion of each grain.

2. An emulsion according to claim 1, wherein said tabular silver halide grains have a grain thickness of less than 0.5 μm, a grain size of not less than 0.3 μm, and an aspect ratio of not less than 2, and account for at least 50% of a total projected area of said silver halide grains.

3. An emulsion according to claim 1, wherein said tabular silver halide grains have an aspect ratio of not less than 2 and less than 8.

4. An emulsion according to claim 3, wherein said tabular silver halide grains have a grain size of not less than 0.3 μm and less 5 μm.

5. An emulsion according to claim 3, wherein said tabular silver halide grains have a grain thickness of not less than 0.05 μm and less than 0.5 μm.

6. An emulsion according to claim 1, wherein said tabular silver halide grains have a grain size of not less than 0.3 μm and less than 5 μm.

7. An emulsion according to claim 1, wherein said tabular silver halide grains have a grain thickness of not less than 0.05 μm and less than 0.5 μm.

8. An emulsion according to claim 1, wherein said tabular silver halide grains have a grain thickness of less than 0.5 μm, a grain size of not less than 0.3 μm, and an aspect ratio of not less than 2 and less than 8, and account for at least 50% of a total projected area of said silver halide grains.

9. An emulsion according to claim 1, wherein said tabular silver halide grains have a grain thickness of less than 0.5 μm, a grain size of not less than 0.3 μm, and an aspect ratio of not less than 2 and less than 8, and account for at least 80% of a total projected area of said silver halide grains.

10. An emulsion according to claim 1, wherein said tabular silver halide grains have a grain thickness of not less than 0.05 μm and less than 0.5 μm, grain size of not less than 0.3 μm and not more than 5 μm, and an aspect ratio of not less than 2 and less than 8, and account for at least 50% of a total projected area of said silver halide grains.

11. An emulsion according to claim 1, wherein said tabular silver halide grains have a grain thickness of not less than 0.05 μand less than 0.5 μm, a grain size of not less than 0.3 μm and not more than 5 μm, and an aspect ratio of not less than 2 and less than 8, and account for at least 80% of a total projected area of said silver halide grains.

12. An emulsion according to claim 1, wherein said tubular silver halide grains have a grain thickness of not less than 0.05 μm and less than 0.5 μm, a grain size of not less than 0.3 μm and not more than 5 μm, and an aspect ratio of not less than 3 and less than 8, and account for at least 80% of a total projected area of said silver halide grains.

13. An emulsion according to claim 1, wherein said tabular silver halide grains have a grain thickness of not less than 0.05 μm and less than 0.5 μm, a grain size of not less than 0.3 μm and not more than 5 μm, and an aspect ratio of not less than 2 and less than 8, and account for at least 50% of a total projected area of said silver halide grains, and wherein a variation coefficient in size distribution of said grains is not more than 20%.

14. An emulsion according to claim 1, wherein said tabular silver halide grains have a grain thickness of not less than 0.05 μm and less than 0.5 μm, a grain size of not less than 0.3 μm and not more than 5 μm, and an aspect ratio of not less than 2 and less than 8, and account for at least 80% of a total projected area of said silver halide grains, and wherein the variation coefficient in size distribution of said grains is not more than 20%.

15. A photographic light-sensitive material having at least two light-sensitive silver halide emulsion layers having different color sensitivities on a support, wherein at least one of said emulsion layers contains a silver halide photographic emulsion containing tabular silver halide grains which have a grain thickness of less than 0.5 μm, a grain size of not less than 0.3 μm, and an aspect ratio of not less than 2, in which dislocations are concentrated in a center portion of each grain, and which account for at least 50% of a total projected area of said silver halide grains, and wherein said at least one of said emulsion layers contains at least one type of a coupler which is coupled with an oxidant of a color developing agent to develop a color.

16. A photographic light-sensitive material according to claim 15, wherein said tabular silver halide grains have a grain thickness of less than 0.5 μm, a grain size of not less than 0.3 μm, and an aspect ratio of not less than 2 and less than 8, and account for at least 50% of a total projected area of said silver halide grains.

17. A photographic light-sensitive material according to claim 15 wherein said tabular silver halide grains have a grain thickness of less than 0.5 μm, a grain size of not less than 0.3 μm, and an aspect ratio of not less than 2 and less than 8, and account for at least 80% of a total projected area of said silver halide grains.

18. A photographic light-sensitive material according to claim 15, wherein said tabular silver halide grains have a grain thickness of not less than 0.05 μm and less than 0.5 μm, a grain size of not less than 0.3 μm and not more than 5 μm, and an aspect ratio of not less than 2 and less than 8, and account for at least 50% of a total projected area of said silver halide grains.

19. A photographic light-sensitive material according to claim 15, wherein said tabular silver halide grains have a grain thickness of not less than 0.05 μm and less than 0.5 μm, a grain size of not less than 0.3 μm and not more than 5 μm, and an aspect ratio of not less than 2 and less than 8, and account for at least 80% of a total projected area of said silver halide grains.

20. A photographic light-sensitive material according to claim 15, wherein said tabular silver halide grains have a rain thickness of not less than 0.05 μm and less than 0.5 μm, a grain size of not less than 0.3 μm and not more than 5 μm, and an aspect ratio of not less than 3 and less than 8, and account for at least 80% of a total projected area of said silver halide grains.

* * * * *